United States Patent [19]

Takeda et al.

[11] 4,370,638

[45] Jan. 25, 1983

[54] DOUBLE-FUNCTION SOLENOID OPERATED SWITCH

[75] Inventors: Nobuhiro Takeda; Shigeo Mizuno; Masaichi Hattori; Yukio Takaishi, all of Aichi, Japan

[73] Assignee: Tokai Rika Co., Ltd., Aichi, Japan

[21] Appl. No.: 264,784

[22] Filed: May 18, 1981

[30] Foreign Application Priority Data

May 19, 1980 [JP] Japan ..... 55-67431[U]

[51] Int. Cl.[3] ..... H01H 45/02; H01H 3/20

[52] U.S. Cl. ..... 335/186; 335/164

[58] Field of Search ..... 335/186, 164, 165

[56] References Cited

U.S. PATENT DOCUMENTS 3,842,375 10/1974 Collette ..... 335/186

*Primary Examiner*—Harold Broome

*Attorney, Agent, or Firm*—Koda and Androlia

[57] ABSTRACT

A switch structure in which manual reset of the automatic knob is performed against the urging force of spring of sliding rod and is not affected by the energizing power supply to be solenoid with much improvement of operational feeling, in which one-way driving type solenoid and automatic knob holding performed by way of detent plate having moderating portion urged by the spring can make the switch means in light weight and small size and in which the usage of movable moderating plate for resetting manual knob makes easy actual installation in the limited space.

3 Claims, 5 Drawing Figures

DOUBLE-FUNCTION SOLENOID OPERATED SWITCH

BACKGROUND OF THE INVENTION

1. Field of the Invention

The present invention relates to a switch structure to serve for a variety of uses and more particularly to a switch structure preferably used for a switch for a automobile such as a window regulator switch, a sun roof switch, an automatic antenna switch, a turn signal switch, etc.

2. Description of Prior Art

A window regulator switch for automobiles, taken as a preferable example of switch means of this kind, comprises an automatic knob which holds on the electric power for a motor by the self holding action of a solenoid after it is once operated until the window is put in the fully opened or closed state, and with a manual knob which does not perform self holding action the window can be moved up and down only when the knob is put in an operational state. Conventionally, in order for self holding when the above mentioned automatic knob is in the window driving states of either closing or opening, the core of the solenoid should selectively move its operational position to hold the automatic knob in two ways i.e. either window opening direction or closing direction. Accordingly, it cannot be free from drawbacks such as the solenoid becomes sizable. In addition, in order to release the self holding state of the automatic knob by the manual operation, there is required to an operational force exceeding to an attracting force of the solenoid. The changes of the voltage applied to the solenoid, therefore, vary the operational force required for resetting the automatic knob, which caused drawback another drawbacks of clumsy operation.

SUMMARY OF THE INVENTION

Accordingly, it is a general object of the present invention to provide a good operational switch structure by which the above mentioned drawbacks are eliminated by means of a small size solenoid which attracts the core to a predetermined direction and yet makes it possible to perform both actions of opening and closing.

BRIEF DESCRIPTION OF THE DRAWINGS

The above mentioned features and object of the present invention will become more apparent by reference to the following description in conjunction with the accompanying drawings, wherein like referenced numerals denote like elements, and in which.

DETAILED DESCRIPTION OF THE INVENTION

The present invention is described in detail with the following preferred embodiment by reference to the accompanied drawings of FIGS. 1 through 4.

Figure 1:
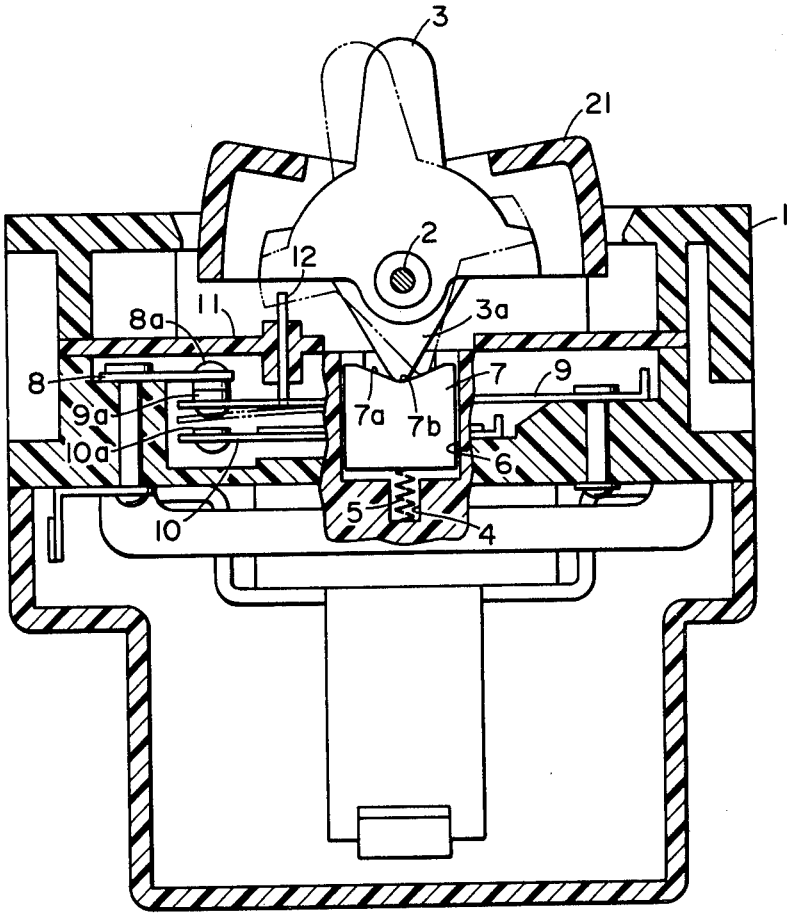
FIG. 1 is a cross sectional view showing the driving mechanism of a manual knob in accordance with the teachings of the present invention.

A frame is denoted as numeral 1, and numeral 2 denotes a pin which pivotedly and tiltingly supports a manual knob 3 against the frame 1. At the lower portion of the manual knob 3, a projection 3*a* solidly provided to confront a moderator 7 having a moderating portion consisting of inclined surfaces 7*a* and bottom 7*b*. The moderator 7 is held within a slit 6 provided in the frame 1 so that the moderator 7 can slide up and down as shown in FIG. 1. Furthermore, at the bottom of the slit 6 is a hole 4 in which a spring 5 is arranged to continuously urge the moderator 7 in an upward direction. Cards 12, 12' are held along a guide 11 which is fixed to the frame 1 so that the cards 12, 12' can slide up and down freely, and one end of each card 12, 12' confronts leaf springs 9 and 9' which have contact points 9*a* and 9*a'* which are arranged to be able to make contact with contact points 8*a*, 8*a'* of contacts plates 8, 8' or with contact points 10*a*, 10*a'* of contact plates 10, 10'.

Figure 3:
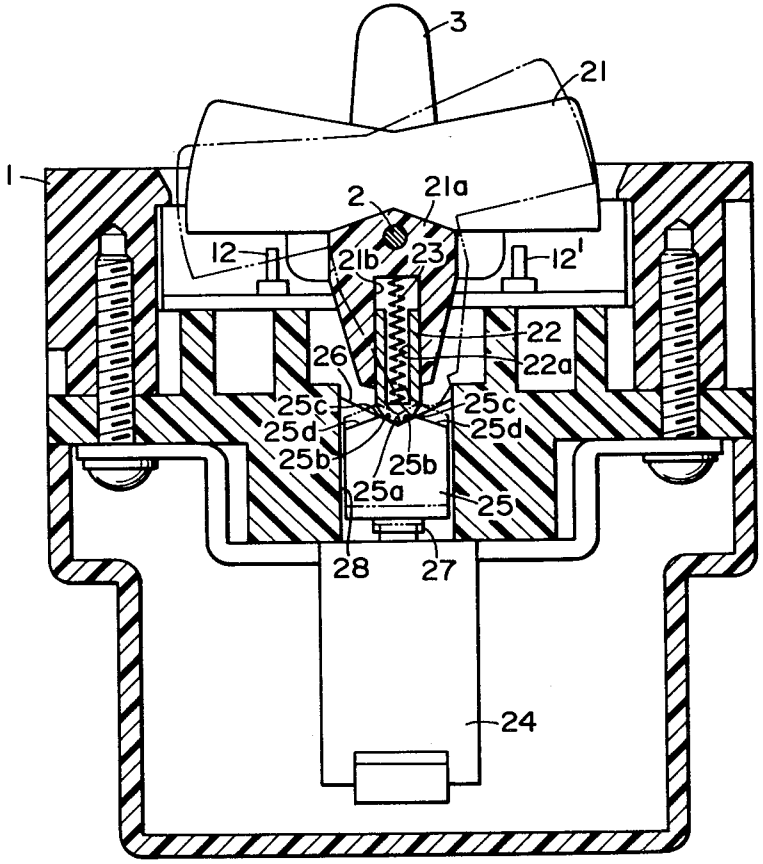
FIG. 3 is a cross sectional view showing the driving mechanism of an automatic knob in accordance with the teachings of the present invention.
Figure 2:
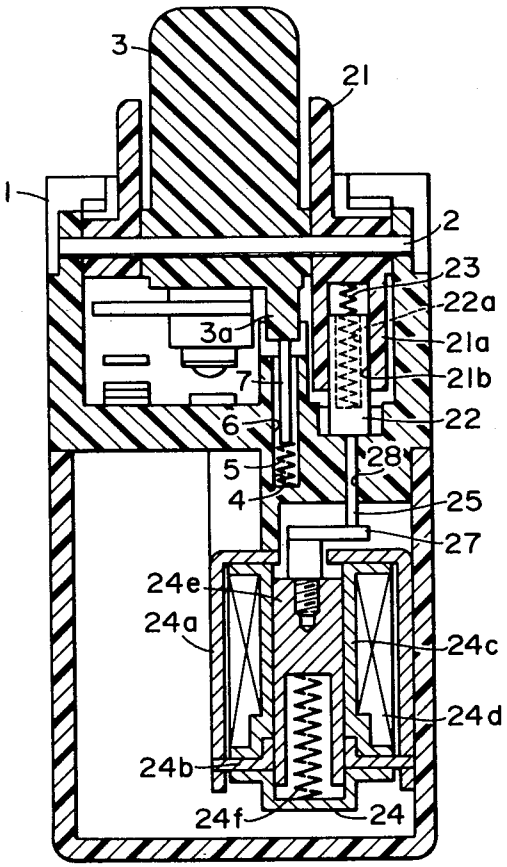
FIG. 2 is a side sectional view of the embodiment shown in FIG. 1.

An automatic knob 21 is pivotedly and tiltingly supported by the pin 2 which is fixed to the frame 1, and has a projection 21*a* in its lower portion. In the projection 21*a* is formed a hole 21*b* in which a sliding rod 22 is held so that it can slide up and down freely, and can be continuously urged by a first spring 23 in a downward direction as shown in FIG. 3. The sliding rod 22 confronts moderating convexes 26 as well as a detent plate 25 having a moderating portion consisting of inwardly inclined surfaces 25*b*, bottom 25*a* and tops 25*c*. The detent plate 25 which can slide inside of a slit 28 being formed across the center portion of two moderating convexes 26 makes close contact with a detent arm 27 which is driven by a one-way solenoid 24. The solenoid 24 possesses a coil 24*d* wound around a bobbin 24*c*, yokes 24*a* and 24*b* which surround the coil 24*d*, a core 24*e* which can slide up and down, and a second spring 24*f* which continuously urge the core 24*e* upward. The detent arm 27 is fixed to the core 24*e*.

The operation of the switch structure of this invention is described in the following.

In FIG. 1, when the manual knob 3 is tilted counterclockwise by a driver or a passenger against the urging force of the spring 5, the end portion of the knob 3 pushes the card 12 in the downward direction. The contact point 9*a* of the leaf spring 9 which is normally kept in contact with the contact point 8*a* is changed over to make contact with the contact point 10*a* since the leaf spring 9 is pushed down by the card 12. Accordingly, a motor, which is not illustrated, is supplied electric power to be rotated in a regular direction, and drives the window open, for example. When the driver or passenger releases the manual knob 3, the projection 3*a* of the knob 3 is turned clockwise along the inclined surface 7*a* on the right side of the moderator 7 in FIG. 1 by means of the urging force of the spring 5, and set to be positioned in the bottom 7*b*. At this time, the leaf spring 9 is reset by its own force of restitution, and the contact point 9*a* again makes contact with the contact point 8*a*. Thus, the electric power supplied to the motor is released and the motor is stopped so that the window stays at this selected setting position.

Figure 4:
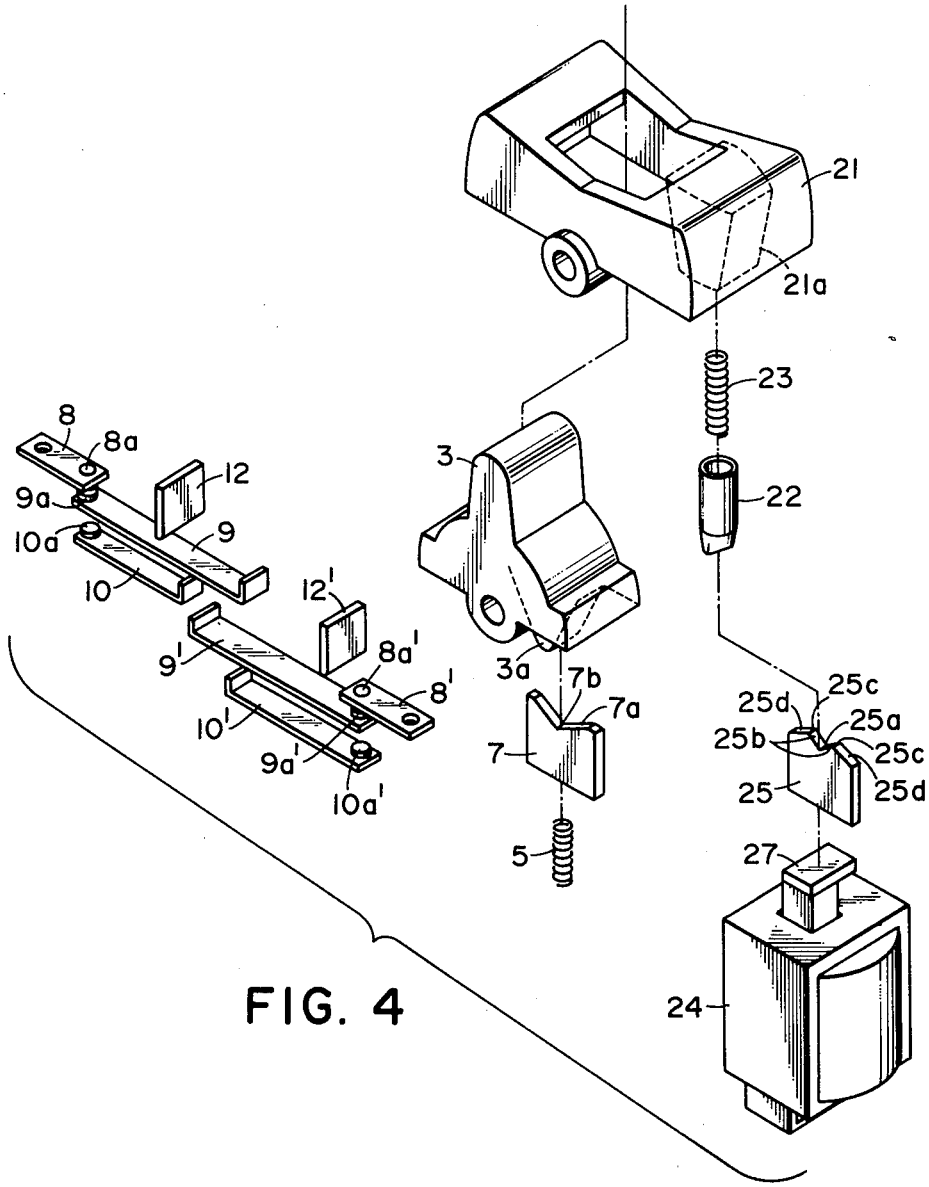
FIG. 4 is a perspective exploded view illustrating an assembly state in accordance with the teachings of the present invention.

In the same manner, when the knob 3 is tilted clockwise, the card 12' is pushed down and the contact point 9a' which is normally kept in contact with the contact point 8a' is changed over to make contact with the contact point 10a' as referred from FIG. 4. At this time the motor rotates in the reverse direction to drive the window in a closing direction. Being released, the projection 3a of the manual knob 3 is turned counterclockwise along the inclined surface 7a on the left side of the moderator 7 in FIG. 1 and set to be positioned in the bottom 7b. Accordingly, the motor stops its rotation and the window stays at this newly selected setting position.

In FIG. 3, when the automatic knob 21 is tilted counterclockwise by a driver or a passenger against the urging force of the spring 23, the sliding rod 22 slides along the moderating convex 26. Then, the end portion of the knob 21 pushes down the card 12 and the motor rotates in an regular direction. At this time the energizing power is also supplied to the solenoid 24 and the detent plate 25 is pushed up to upward direction. The sliding rod 22 is positioned and stays between the inclined surface on the right side of the moderating convex in FIG. 3 and the inclined surface 25d on the right side of the detent plate 25. Accordingly, the motor continues rotating even if a driver or a passenger disengages his hand from the automatic knob 21. When the window is fully opened, a limit switch, which is not illustrated, is activated to stop supplying the energizing power to the solenoid 24. Then, the urging force of the spring 23 surpasses the urging force of the spring 24f of the solenoid 24 to move the sliding rod 22 to a concave portion over the moderating convex 26 as well as to push down the detent plate 25 at the same time. Accordingly, the self holding of the automatic knob is released and the motor stops rotating.

In the same manner, when the automatic knob 21 is tilted clockwise, the sliding rod 22 is positioned and stays between the inclined surface on the left side of the moderating convex 26 in FIG. 3 and the inclined surface 25d on the left side of the detent plate 25, and the operation is the same as mentioned in the above other than the reverse rotation of the motor.

When the automatic knob 21 is to be released after being once operated, the automatic knob has only to be tilted to the reverse direction from the present holding direction. The sliding rod 22 moves to slide over the top 25c of the detent plate 25 and returns to the bottom 25a. Accordingly, the motor stops rotating and also discontinuance of the energizing power supplied to the solenoid 24 releases the self holding of the automatic knob 21.

Figure 5:
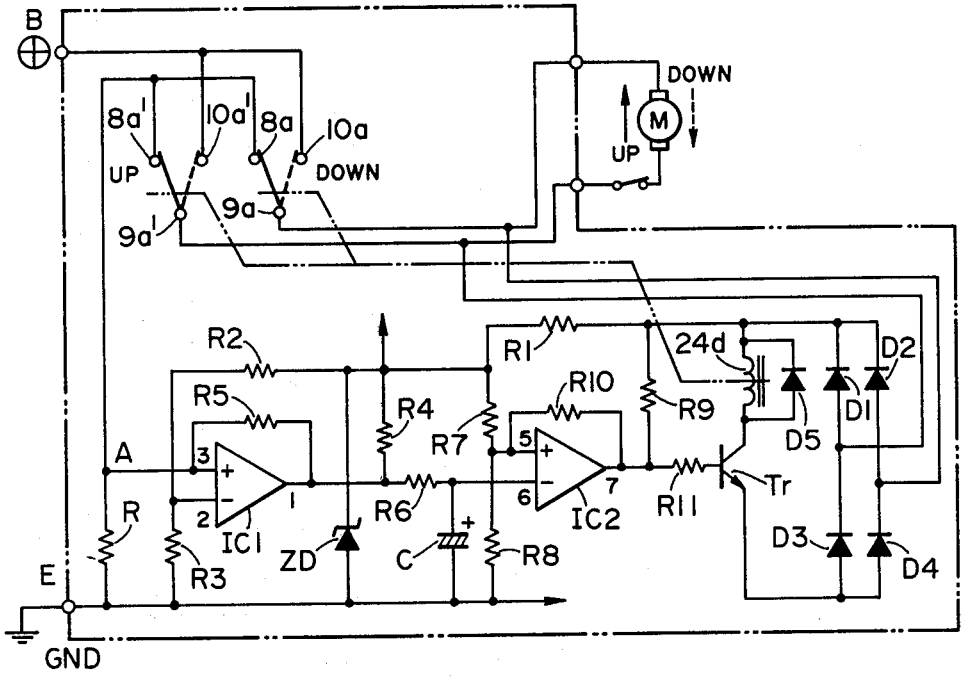
FIG. 5 is a circuit diagram of a switch control circuit in the preferred embodiment of the present invention.

In FIG. 5 shown therein is a circuit diagram of the switch control circuit for operating the above switch structure. Between the contact points 9a and 9a', there is connected a motor M which drives the window upward or downward and to the motor M, a resister R is connected in series to detect motor current. The corresponding motor current of the resister R is supplied to the one input terminal of operational amplifier $IC_1$, which forms a comparator together with resisters R2, R3, R4, R5 and a Zener diode ZD to operate at a predetermined value, 13.5 amperes in the embodiment. The output of the operational amplifier $IC_1$ is supplied to one input of the operational amplifier $IC_2$ by way of a time constant circuit composed of resisters R4 and R6 and a capacitor C. The operational amplifier $IC_2$ forms a comparator together with resisters R1, R7, R8, R9 and R10. The output of this comparator is supplied to the base of transistor Tr by way of a resister R11, and excites solenoid coil 24d which is connected to the collector of the transistor Tr. The solenoid 24 is connected to a diode D5 to bypass the reverse electromotive force, and to the one end of the solenoid coil 24d are connected diodes D1, D2, D3 and D4.

The operation of FIG. 5 is described hereinafter in reference to the above-mentioned manual knob 3 and automatic knob 21.

When the manual knob 3 is operated to the UP side, the contact point 9a' is switched from 8a' and 10a' and the current flows from a power source terminal to the contact point 9a', motor M, the resister R, and a ground terminal to have the motor M rotate to the UP side. At the same time, the power is also supplied from the B terminal to the solenoid 24 by way of the diode D1, but the solenoid 24 is not operated since the automatic knob 21 mechanically obstructs the solenoid 24. Accordingly, when the hand is released from the manual knob 3, the knob returns to the neutral position and the contact point 9a' returns to the position 8a'. The supply of the motor current is cut off and the motor stops rotating.

When the automatic knob 21 is operated to the UP side, the contact point 9a' is switched from 8a' to 10a', and the motor M receives current in the same way as the manual case to rotate toward the UP side. And also the current is supplied to the control circuit by way of the diode D1. At this time, the output of $IC_1$ stays at a low level and the output of $IC_2$ stays at a high level, since the motor load is not so large and the motor current flowing through the resister R does not exceed the predetermined value, that is, 13.5 amperes. Accordingly, base current flows through transistor Tr to operate the solenoid 24.

At the completion of the upward window movement, the motor M receives the lock current which is bigger than the motor current. The electric potential at the point A is bigger than the predetermined value, which is detected by $IC_1$ to cause the "1" terminal of $IC_1$ to become a high level. The "6" terminal of $IC_2$ becomes a high level about 0.7 seconds later by a charging time constant of (R4+R6)C, and the "7" terminal of $IC_2$ becomes a low level to put the transister Tr in the off-state. Accordingly, the current to the solenoid 24 is cut off and the automatic knob 21 returns to the neutral position by its self returning force to cut off the motor current.

Also, in the case when the motor current exceeds the detecting current of 13.5 amperes when the window hits the weather strip, etc. just before the completion of upward movement, the motor does not stop immediately but continues its rotation for about 0.7 seconds in order to drive the window firmly upward.

When the manual knob is operated to the DOWN side, while the window is moving upward in the UP hold state, the current of the solenoid flowing to Tr, D4, 9a, R and E in order is cut off so that the automatic knob 21 returns and the motor stops rotating. Even if the contact point 9a does not open at this time, further stronger operation of the manual knob 3 to the DOWN side makes the manual knob 3 engage with the automatic knob 21 and the forced return of the manual knob 3 stops the motor rotation. The consecutive operation of the manual knob 3 toward the DOWN side makes the motor start reverse rotation.

The operation of the automatic knob 21 to the DOWN side makes it possible to release the UP hold state. When the automatic knob 21 is further pushed stronger toward the DOWN side at this time, the knob is put in the DOWN hold state to have the motor continue reverse rotation.

Completely reverse operation from the UP action makes it possible to perform the DOWN action in the same way as the UP action.

As described heretofore, according to the present invention, the rotating action of the automatic knob by means of manual operation is performed against the urging force of the spring 23 by the sliding rod 22 and has much stability without any effect from the energizing electric power supply to the solenoid. The operational feeling is thus improved.

Furthermore, since the solenoid can be selected out of one way driving types, and the automatic knob is held by way of the detent plate having the moderating portion urged by the spring, a switch means can be provided which is light in weight and small in size. Also, the movable moderating plate is urged in order to reset the manual knob, and it is easy to provide a switch means if the space is limited on the manual knob side.

We claim:

1. A double-functional solenoid-operated switch comprising:

a frame;

an automatic knob pivotally coupled to said frame;

a sliding rod inserted in a hole formed in said automatic knob;

a first spring inserted in said hole to urge said sliding rod toward an opening of said hole;

a moderating plate having on its top a notch over which said sliding rod slides;

a detent plate on which said sliding rod slides along, said detent plate having a moderating portion which holds said sliding rod together with said moderating plate and being installed in said frame so as to slide freely in the axis direction of said sliding rod; and a solenoid having a second spring which continuously urges said detent plate toward the axis direction of said sliding rod through a core.

2. A switch according to claim 1 further comprising:

a manual knob pivotally coupled to said frame; and contact points provided on leaf springs confronting a pair of cards which is operated by said automatic knob and manual knob.

3. A switch according to claim 2, further comprising a projection which is solidly molded at the lower portion of said manual knob and arranged to confront a moderator having a moderating portion consisting of inclined surfaces and bottom portion, said moderator being held within a slit provided in said frame so that the moderator can slide up and down and be continuously urged toward said projection by a spring provided in the hole formed in said slit.

* * * * *